US009623536B2

(12) United States Patent
Nüsslein

(10) Patent No.: US 9,623,536 B2
(45) Date of Patent: Apr. 18, 2017

(54) DEVICE FOR POLISHING WORKPIECE SURFACES

(75) Inventor: Tobias Nüsslein, Geretsried/Gelting (DE)

(73) Assignee: DECKEL MAHO Seebach GmbH, Seebach (DE)

( * ) Notice: Subject to any disclaimer, the term of this patent is extended or adjusted under 35 U.S.C. 154(b) by 541 days.

(21) Appl. No.: 14/009,967

(22) PCT Filed: Apr. 5, 2012

(86) PCT No.: PCT/EP2012/001534
§ 371 (c)(1),
(2), (4) Date: Dec. 13, 2013

(87) PCT Pub. No.: WO2012/136376
PCT Pub. Date: Oct. 11, 2012

(65) Prior Publication Data

US 2014/0134932 A1 May 15, 2014

(30) Foreign Application Priority Data

Apr. 6, 2011 (DE) ..... 20 2011 004 912 U

(51) Int. Cl.
*B24B 31/116* (2006.01)
*B24B 57/02* (2006.01)
(Continued)

(52) U.S. Cl.
CPC ..... *B24B 29/04* (2013.01); *B24B 29/00* (2013.01); *B24B 31/116* (2013.01); *B24B 57/02* (2013.01); *B24D 13/147* (2013.01)

(58) Field of Classification Search
CPC ..... B24B 29/00; B24B 37/04; B24B 57/02
(Continued)

(56) References Cited

U.S. PATENT DOCUMENTS 4,956,944 A * 9/1990 Ando ..... G05B 19/4166 451/159
6,796,877 B1 * 9/2004 Bingham ..... B24B 1/00 451/147
(Continued)

FOREIGN PATENT DOCUMENTS

DE 10314625 B3 * 10/2004 ..... B24B 13/00
DE 102006017664 A1 10/2007
(Continued)

OTHER PUBLICATIONS

International Search Report (PCT/EP2012/001534, dated Jun. 3, 2012), 2 pages.

*Primary Examiner* — Monica Carter
*Assistant Examiner* — Lauren Beronja
(74) *Attorney, Agent, or Firm* — The Maxham Firm

(57) ABSTRACT

A device for polishing metallic workpiece surfaces. The device includes a tool holder which can be exchangeably fitted into a rotationally driven working spindle of a program-controlled milling machine, and a polishing tool, which is fastened in the tool holder. The device also includes a tool shank and a polishing head at the free end thereof, and is coupled to a polishing agent supply which arrives at the effective surface of the polishing head. The tool shank contains a chamber, which can admit a pressure medium and is at least partially filled with the polishing agent, wherein this chamber is in connection with the polishing head by way of a channel and wherein the polishing head has polishing agent permeable material or it contains passages for the polishing agent that is forced out of the chamber.

18 Claims, 3 Drawing Sheets

(51) Int. Cl.
*B24D 13/14* (2006.01)
*B24B 29/04* (2006.01)
*B24B 29/00* (2006.01)

(58) Field of Classification Search
USPC ..... 451/5, 60, 288
See application file for complete search history.

(56) References Cited

U.S. PATENT DOCUMENTS

| | | | | |
|---|---|---|---|---|
| 2004/0185750 | A1* | 9/2004 | Kurogouchi | B24B 13/00 451/5 |
| 2010/0159809 | A1* | 6/2010 | Schneider | B24B 13/02 451/42 |

FOREIGN PATENT DOCUMENTS

| | | | |
|---|---|---|---|
| DE | 202011004912 | U1 | 2/2012 |
| EP | 0196832 | A2 | 10/1986 |

* cited by examiner

WZ_SK40

WZ_HSK63

DEVICE FOR POLISHING WORKPIECE SURFACES

FIELD OF INVENTION

This invention relates generally to an apparatus for polishing preferably metallic workpiece surfaces, and more particularly concerns a polishing tool which can be moved in several axes and has a polishing head attached thereto.

BACKGROUND OF THE INVENTION

Although a plurality of polishing machines having fine grinding or polishing tools, or both, for polishing the most differing workpieces are known, the machined surfaces of structures produced in machining centers and program-controlled milling machines have typically been high-gloss polished by hand to date. When the structures have large volumes for presses, the polishing work to be carried out manually is extremely time-consuming. Furthermore, since the structures often have complex surfaces including roundings, edges, and curvatures, automated polishing of the entire surfaces, including their critical areas, was formerly not possible by means of the program-controlled milling machine. The polishing of pressed and cast parts which, to obtain high gloss, is usually to be carried out in several steps by hand of also by means of power tools, is extremely time-consuming and calls for highly qualified, experienced staff.

In order to polish simply curved glass surfaces in the production of optical lenses, it is known from German patent DE 101 14 625 B3 to remove material in well-calculated fashion on the workpiece surface by fine grinding or polishing using a rotationally driven polishing tool. The polishing tool contains a tool shank which is fixed in a spindle of a special polishing machine or a robot by means of a tool holder. A hollow-cylindrical head is mounted on the tool shank, and a cylindrical polishing member is received in a longitudinally movable fashion in the outwardly open chamber of the head. A polishing suspension impinges on the inner rear side of the polishing member which is moved in rotating and oscillating fashion and forces the polishing member with its annular and cylindrical polishing surface against the curved surface of the glass workpiece. The polishing suspension passes through an annular gap between the polishing element and the chamber wall and reaches the glass surface to be polished. This apparatus cannot be used in program-controlled milling machines and machining centers and cannot process the curvatures which are often narrow in the case of pressed parts with the required accuracy.

In addition, a method and an apparatus for the production of structures is known from German patent application DE 10 2006 017 664 A1, wherein a three-dimensional structure is milled out of a material block by means of a processing machine and then the structure surface is smoothed in several processing operations by fine grinding and polishing using the work spindle movable in five axes. The tools used for polishing have an approximately spherical head which is attached to the free end of a longitudinally movable pin. The polishing head consists of a suitable material deformable within limits, made, for example, of felt, fabric fibers, plastic material, among others. The polishing head is pressed on the structure surface of the respective workpiece, which is to be smoothed, at a predetermined contact pressure by means of an installed spring element, wherein the quantity of the contact pressure can be adjusted via the machine control.

However, these polishing operations often create problems with respect to effective supply of the polishing agent to the surface area to be processed.

SUMMARY OF EMBODIMENTS OF THE INVENTION

A purpose of embodiments of the invention is to create a system for the automated polishing of, in particular, machined workpiece surfaces by means of a program-controlled milling machine, wherein the system can be integrated into the operating sequences of the milling machine and guarantees an optimization of the polishing operations and a controlled supply of the polishing agent to the processed surface area.

In order to achieve the above-mentioned purpose, the structure is an apparatus for polishing machined workpieces, and includes a polishing tool which can be exchangeably fitted into the work spindle of the processing machine and has a polishing head arranged on the end side thereof. The tool shank of the polishing tool contains a pressurized chamber which is at least partially filled with a polishing agent and is connected to the polishing head, wherein the polishing head has passages for the polishing agent to be forced out of the chamber. The multi-part polishing tool, which is movable via the work spindle of the machine tool in several axes, in particular in five axes, contains a shank and a polishing head attached to the free end thereof. The tool shank can be mounted on a tool holder, for example, what is called a machine taper, which is clamped as usual in the work spindle of the CNC-controlled milling machine. The polishing head, which is rotationally driven in predetermined speed ranges of several 1000 rpm via the work spindle, preferably consists, of a wear-resistant deformable material and is moved over the workpiece surface to be processed at a virtually constant slight contact pressure by means of the work spindle.

An aspect of an embodiment of the invention is that the polishing tool, or also a series of different polishing tools, is integrated into the functional system of a program-controlled milling machine operating preferably in five axes, and therefore the workpiece can be polished, optionally in several stages, with equal clamping and without temporal interruption when the grinding or smoothing, or both, operations have been concluded. The operating system according to the invention allows for the possibility of having several polishing tools with the respective tool holders available in a correspondingly designed tool magazine and of exchangeably fitting them into, or removing them from, the work spindle as usual and as required using the machine-specific tool changer. Since the polishing work, for example, consisting of prepolishing and high gloss polishing, takes considerable time, it is recommended to polish relatively large workpieces during the night shift.

In an advantageous exemplary embodiment of the invention, a pressure medium channel communicating with the pressure medium supply of the machine tool is formed in the tool shank, that channel extending either to the shank end or to a chamber in the shank, the chamber forming a piston-cylinder unit. A pressure medium of the machine tool impinges on the piston of this piston-cylinder unit via the longitudinal channel and the piston is pressed against a polishing agent filling with which the cylinder chamber is filled. The more or less viscous polishing agent is forced via the terminally discharging bores in the tool shank into the polishing head by means of the pressure exerted on the piston which is longitudinally slidable in the chamber. The polishing head is thus supplied with the polishing agent. In order for the polishing agent to reach the outer surface of the polishing head in sufficient and adjustable amount, the polishing head has passages for the polishing agent. For this purpose, the polishing head can have a suitable porosity or fine through-holes. The polishing agent is uniformly distributed over the head surface be means of the centrifugal forces which are effective white the polishing head rotates.

In a variant of the apparatus according to en embodiment of the invention, which is particularly useful in practice, the piston-cylinder unit is made as an exchangeable cartridge which can be inserted in the chamber of the tool shank. This cartridge preferably consists of a suitable, cost-effective, plastic material and its cylinder chamber below the piston is filled with a predetermined amount of polishing agent. The polishing agent can have a viscosity and grain size which are selected specifically for the particular polishing process to be carried out.

The tool shank can preferably consist of several individual parts, for example, of a machine-side clamping part which has fixing and clamping members for the fixed installation in a tool holder and a shank part containing the piston-cylinder unit and the polishing head. The outer shank part of this polishing tool can be exchangeable and can have different diameters and lengths, for example, so as to be able to carry out diverse polishing operations. Having detached the connecting members to the machine-side clamping part, the external shank part can be disassembled and the cartridge can be exchanged with a new cartridge having the same or another polishing agent.

An optimized adaptation to different workpiece materials and structures can be achieved according to another useful development of the invention by producing the polishing head from suitable fiber-composite materials. By means of a detachable connection of the polishing head to the external shank part, it is possible to exchange, for example, worn polishing heads rapidly and easily. Composite materials have proved to be particularly suitable materials with respect to the effect of removal and to wear; they consist of an elastically deformable inner body and a fabric which is attached to the surface thereof in fixedly adhering manner and is made of synthetic fibers which have an extreme loadability, tensile strength, and temperature resistance and are available, for example, as a PBO fabric under the trade name of "Zylon." The inner rubber holding body of the polishing head can be provided with one or several layers of this PBO fabric. The arrangement of a first layer made of a felted fiber material and, on top thereof, of a coarse-meshed PBO fabric as a wear protection, is also possible in practice.

In the program-controlled milling machines and machining centers in which the apparatus according to embodiments of the invention is inserted, the KS media, such as an internal cooling lubricant, an external cooling lubricant, and outer blow air, are blocked during the polishing operation. What is used is only the blow air through the spindle center of the work spindle, which exerts the necessary pressure on the piston in the piston-cylinder unit and thus also on the polishing agent. This internal blow air is regulated by a pressure control valve, which is driven by the machine control so as to regulate the polishing agent amount forced out of the chamber toward the polishing head. This polishing agent amount supplied to the effective surface of the polishing head can be adjusted or varied via the pressure of the blow air in the work spindle or also by means of an adjustment nozzle depending on the polishing tasks, the materials to be processed, the composition of the polishing agent, and also other parameters of the polishing process, for example, the contact pressure of the polishing head on the workpiece, wherein the adjustment nozzle is arranged in the channel section of the outer shank part between the cylinder chamber and the polishing head.

BRIEF DESCRIPTION OF THE DRAWING

The objects, advantages, and features of the embodiments of the invention will be more clearly perceived from the following detailed description, when read in conjunction with the accompanying drawing, in which.

DETAILED DESCRIPTION OF EMBODIMENTS OF THE INVENTION

Figure 1:
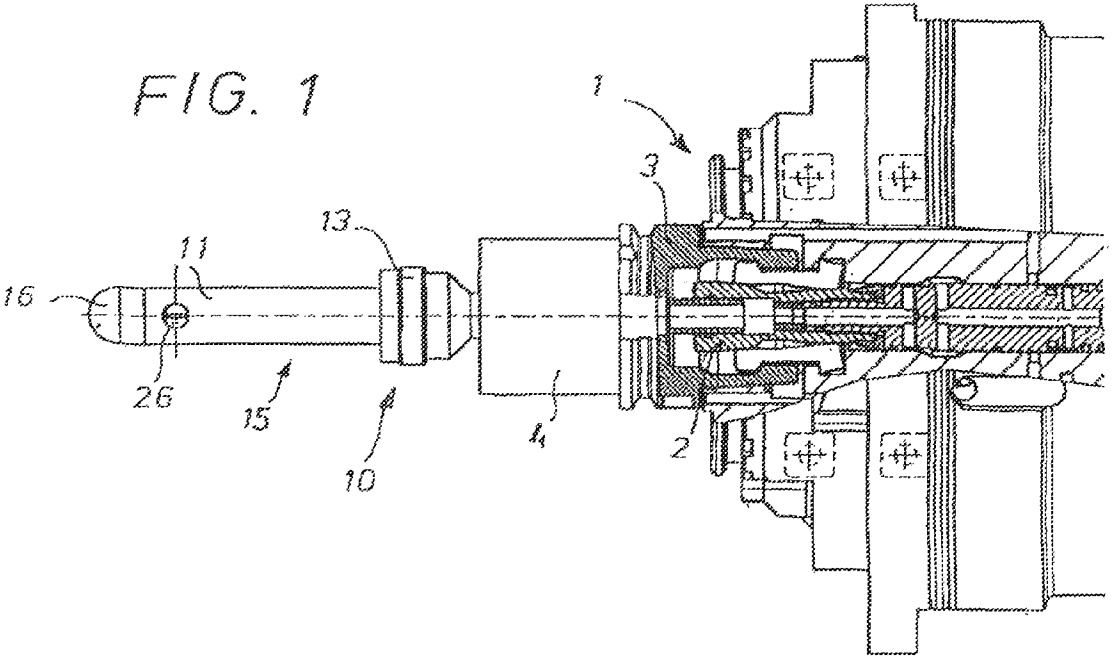
FIG. 1 is a partial sectional side view of the front part of a milling spindle, a tool holder, and a polishing tool design in accordance with an embodiment of the invention.

FIG. 1 shows an axial partial section of the end portion of a work spindle 1 of a milling machine, (not shown) which is program-controlled in five axes, for example, wherein this work spindle is made as what is called a motor spindle. In work spindle 1, a hydraulically clampable mount 2 is accommodated in axially slidable fashion in the central through-hole of the work spindle, and a tool holder 4 can be fixed in detachable fashion via suitable inner clamping elements in work spindle 1 by means of this mount. The work spindle also contains central flow channels for cooling lubricant and compressed air. These fluids are sprayed onto the processed workpiece surface during the milling operation by the milling cutter. Machine holder 4 shown in FIG. 1 corresponds to the design WZ_HSK63 of FIG. 4. Correspondingly, it is possible to use a steep taper tool holder (WZ_SK40 shown in FIG. 3) instead of this tool holder 4, when work spindle 1 is designed correspondingly. Both tool holders can automatically be exchangeably fitted into and removed from the work spindle by means of a common tool changer.

The drawing shows a polishing tool 10 as an exemplary embodiment of the invention, this polishing tool having a tool shank 15 composed of parts 11 and 12 connected via sleeve 13 (see FIG. 2), Both shank parts 11, 12 have a cylindrical outer shape and consist of metal or of a sufficiently rigid and dimensionally stable plastic material to obtain a sufficient flexural rigidity. An approximately semi-spherical polishing head 16 is attached to the free end of the outer shank part 11 and can have an outer diameter which is similar to or slightly larger than that of outer shank part 11.

Polishing head 16 consists of a suitable material, for example, of hardened felt, of a sponge-like or brush-like material, an elastomer which can be shaped within certain limits, a fiber composite material, or the like. In practice, a polishing head has proved particularly successful that has an inner body made of a rubber or elastomer of predetermined hardness, on the surface area of which a fabric made of high-strength synthetic fibers, for example, of a PBO fabric, is fixed. These fibers are available under die trade name of "Zylon."

Figure 2:
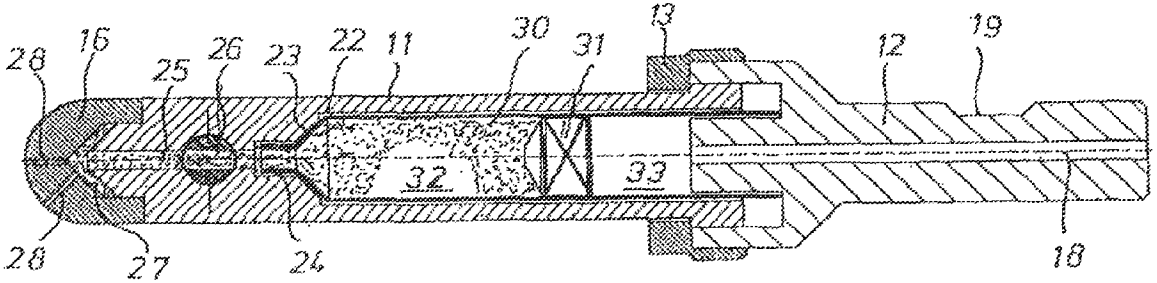
FIG. 2 is an axial sectional view of a polishing tool of FIG. 1 without a tool holder.
Figure 2A:
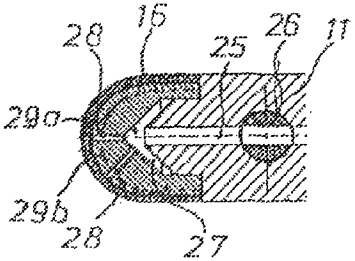
FIG. 2*a* is an axial section of the front part of the polishing tool according to FIG. 2 and having a modified polishing head.

FIGS. 2 and 2*a* show two possible embodiments of polishing heads 16 in a schematic axial section. As shown, each polishing head has a rounded shape or the shape of a spherical segment and can be mounted at the free end portion of shank part 11 in detachable fashion or also permanently, for example, by adhering or vulcanization. What is feasible is also a milling head having a rotary wire brush, the wires of which extend parallel to the axis of rotation of the wire brush and are oriented approximately perpendicularly to the workpiece surface.

Tool shank 15 of polishing tool 10 according to this concept can have several parts or also one part, wherein a liquid or pasty polishing agent, which is required for polishing and has a suitable viscosity, is applied continuously or intermittently to the outer surface of polishing head 16. The multi-part tool shank 15 has a machine-side inner shank part 12 in which a central longitudinal channel 18 is formed. This longitudinal channel is connected to the compressed air system of the milling machine or to the work spindle, or both. In the polishing operation, the compressed air is supplied via a pressure control shown in the diagram of FIG. 5. Pressure control valve 38 regulates the supply of the inner blow air to work spindle 1. The supply of other operating material, such as cooling lubricant, to the work spindle or to polishing tool 10 is blocked during the polishing operation.

Figure 4:
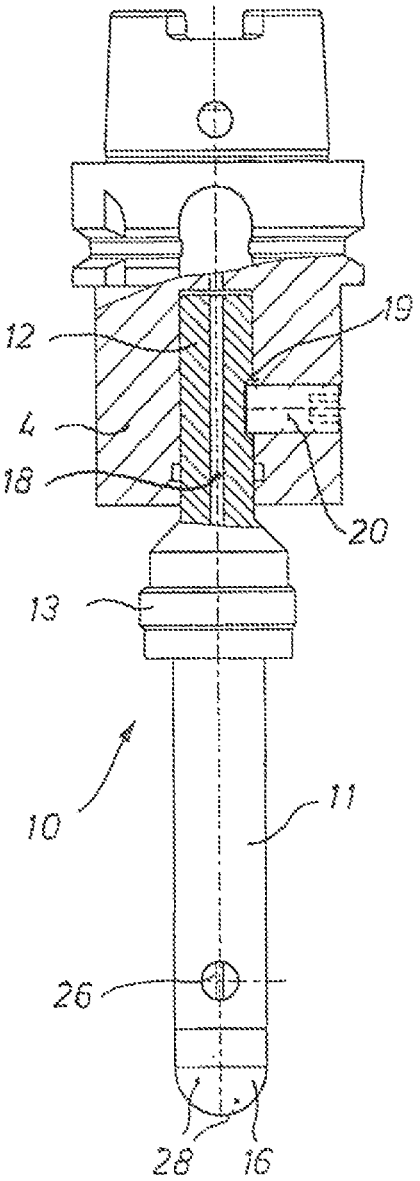
FIG. 4 is a partial sectional side view of a polishing tool clamped in a tool holder of a type different from that shown in FIG. 3.

As also evident from FIG. 2, a locating notch 19 is formed in inner shank part 12 for rotary protection, and a countersunk screw 20 screwed into the tool holder 4 projects into that notch (see FIG. 4). In outer shank part 11, which is on the left-hand side in FIG. 2, cylindrical chamber 22 is made as a recess which is open on the right-hand side and extends over conical end portion 23 to bore 24 of reduced diameter. Downstream of bore 24, a cock-like control valve 26 is disposed in axial channel 25. Channel 25 ends in a funnel-like pressure chamber 27 surrounded by polishing head 16. Several through-holes 28 in the polishing head extend from chamber 37 to the outer side of the polishing head. These bores 28 form passages for a polishing agent forced out of the chamber 22 by pressurizing piston 31 provided in chamber 22 in longitudinally slidable fashion. Chamber 22 can be filled directly with a liquid or pasty polishing agent which is forced to polishing head 16 by the application of an external pressure to displacement piston 31 longitudinally slidable in the chamber.

In polishing tool 10, according to FIG. 2, piston 31 is slidably arranged in an axial direction in the interior of elongated cylindrical chamber 22 in the outer shank portion 11, and the inner blow air of the work spindle impinges on the front side thereof which is shown on the right in FIG. 2 and which is pressed against a polishing agent filling the left-hand portion of the chamber. In this embodiment, shank part 11 can be separated from machine-side shank part 12 by loosening cap nut 13 when the polishing agent is depleted and chamber 22 has to be refilled. The same operation applies when another polishing head 16 needs to be inserted.

An advantageous variant can be taken from FIG. 2. In this embodiment an inexpensive cartridge 30 made of a plastic material, for example, is inserted in the hollow-cylindrical shank part 11, that is, in the cylindrical chamber 22, where the piston 31 is guided in axially slidable fashion. This cartridge 30 extends over the entire length of cylindrical chamber 22 up into a deep annular groove in the widened end portion of shank part 12 on the right-hand side in FIG. 2. Chamber 32 of cartridge 30, which is on the left-hand side in FIG. 2, is filled with a suitable polishing agent. Compressed air is introduced via central longitudinal channel 18 into pressure chamber 33 on the right-hand side of piston 31, either continuously or in the form of time-controlled pressure surges, so as to exert on piston 31 compressive forces directed to the left. Cartridge 30 is held in positive engagement in cylindrical chamber 22 of shank part 11 and also connected in shank part 12 by the threaded sleeve 13. Cartridge 30 and also piston 31 preferably consist of a suitable plastic material and, when the entire polishing agent has been pressed out can be easily exchanged by merely unscrewing threaded sleeve 13 and pulling cartridge 30 out of the shank part.

In the exemplary embodiments as shown, polishing head 16 preferably consists of a body made of elastomer hardened, for example, by fiber cores and made of a rubber of predetermined hardness, for example. The surface of the polishing head can be roughened or have recesses, or both, in the form of slits, notches, or countersinks which have a certain depot function for the polishing agent.

Polishing head 16 can also contain several outer layers, a design of which is shown in FIG. 2*a*. The body of this polishing head also consists of an elastomer optionally reinforced by short fibers, on the outer side of which is a layer 29*a* of a fiber material, for example, a felt, and on top of this layer 29*a* a fabric 29*b*, made of high-strength synthetic fibers, is permanently fixed. This embodiment of the polishing head 16 is extremely wear-resistant, yields desired removal rates depending on the mesh width of fabric 29*b* and has an excellent temperature resistance. The two layers 29*a* and 29*b* are preferably vulcanized into the rubber-like elastomer material. Passages 28 for the polishing agent are also provided in the form of fine bores or capillaries in this polishing head, via which the polishing agent is passed from the conical or funnel-shaped pressure chamber 27 to the outer side of the polishing head.

Figure 3:
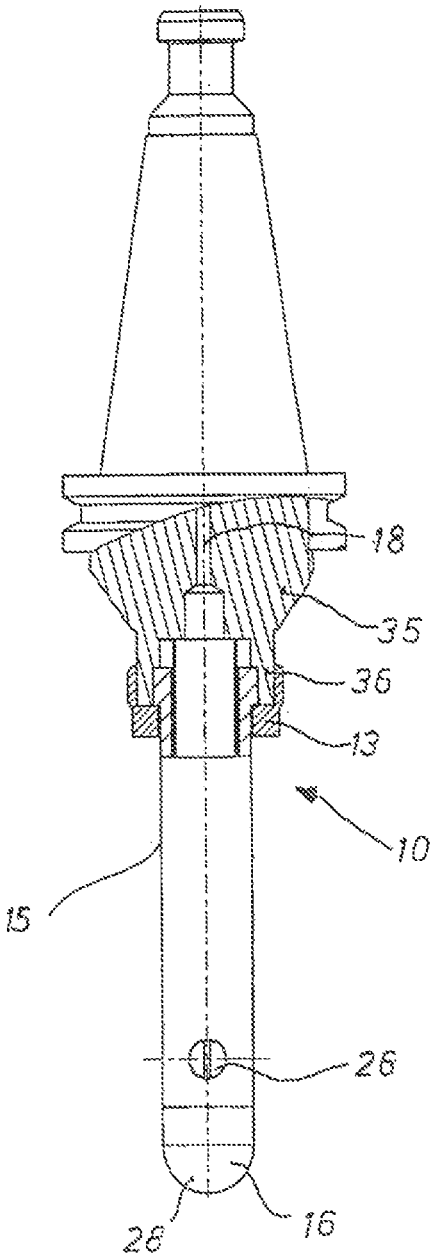
FIG. 3 is a partial sectional side view of a polishing tool that can be clamped in the tool holder of FIG. 1.

In the exemplary embodiment shown in FIG. 3, tool shank 15 of polishing tool 10 corresponds to the outer shank part 11 shown in. FIG. 2, that is, tool shank 15 is made as one piece. This tool holder, referred to as WZ_SK40, is a steep taper holder with a hollow-cylindrical extension 36 formed at integrated end portion 35. A thickened end flange of the shank part 11 meshes with extension 36 and is connected by means of cap nut 13. The functioning of this exemplary embodiment corresponds to that of the embodiment according to FIG. 2. A cartridge 30 having a piston 31 moving longitudinally therein can be used and can be replaced after unscrewing cap nut 13. The cartridge can also be omitted and in this case the polishing agent filling is inserted directly in open chamber 22 of the disassembled tool shank and the displacement piston is positioned.

FIG. 4 shows polishing tool 10 installed in tool holder 4, referred to as WZ_HSK63. Machine-side inner shank part 12 is positioned in the central recess of workpiece holder 4 and is fixed by bolt 20 engaging in groove 19 in the shank. Outer shank part 11 corresponds to those of the exemplary embodiments of FIGS. 1 to 3.

The invention is not limited to the exemplary embodiments as shown. For example, polishing head 16 can be cylindrical with a rounded marginal edge, conical or cone-shaped, or it can also be disk-like instead of having the spherical outer shape as shown. Furthermore, a porous sponge-like material of sufficient strength can be chosen for the polishing head and allows for a continuous passage of the flowable polishing agent selected for this purpose.

The invention embodiments create a processing system by means of which complex cutting faces, also of complex contours, can be milled, ground, and polished up to high-gloss automatically and without manual interference and with one clamping, irrespective of the respective shape of the contours. To this end, the polishing tools formed according to the invention embodiments are used in CNC-controlled five-axis milling machines in the same way as conventional cutting tools, that is, they are held available in a corresponding number in the respective tool magazine and are exchangeably fitted into the work spindle.

Since the work spindles of the milling machines and machining centers used in mold design can be operated in several axes by corresponding swiveling movements of the spindle head or the workpiece table, conditions equal or similar to those for milling result for polishing as well. Thus, there is a further possible use for the highly complex, program-controlled machine tools and machining centers, in particularly during the night shifts, by means of which the workpieces machined in several milling steps beforehand can be ground and finally also polished. In particular the extremely time-consuming polishing operations save considerable time and cost.

In the polishing method using the apparatus according to the invention embodiments, a polishing tool exchangeably fitted into the work spindle automatically by means of the machine control and of the tool changer is rotationally driven and moved contiguously or cyclically in several axes. The settable speeds are usually several 1000 to several 10000 rpm. The polishing tool is moved over the workplace surface to be processed by controlled three-dimensional movements of the work spindle or the workplace, or both, including the possible swiveling movements. The respectively optimized orientation of the polishing tool or the tool shank is given by the machine control so as to ensure that the most effective areas of the polishing head are effective on the workpiece surface.

What is essential for the polishing operation and also tor the smoothness achieved is that the polishing head is moved over the workpiece surface with a virtually constant contact pressure that is optimal according to preselected parameters. The movements are predetermined in respect of speed, trajectory, and direction of the machine control, wherein the polishing movements over the respective surface are repeated until the desired polishing degree has been reached. The constant slight contact pressure of the polishing head is achieved by working with what is called an "undersize," that is, the polishing head dimensions stored in the machine control consider an intended head material deformation which corresponds to a certain pressure value.

Figure 5:
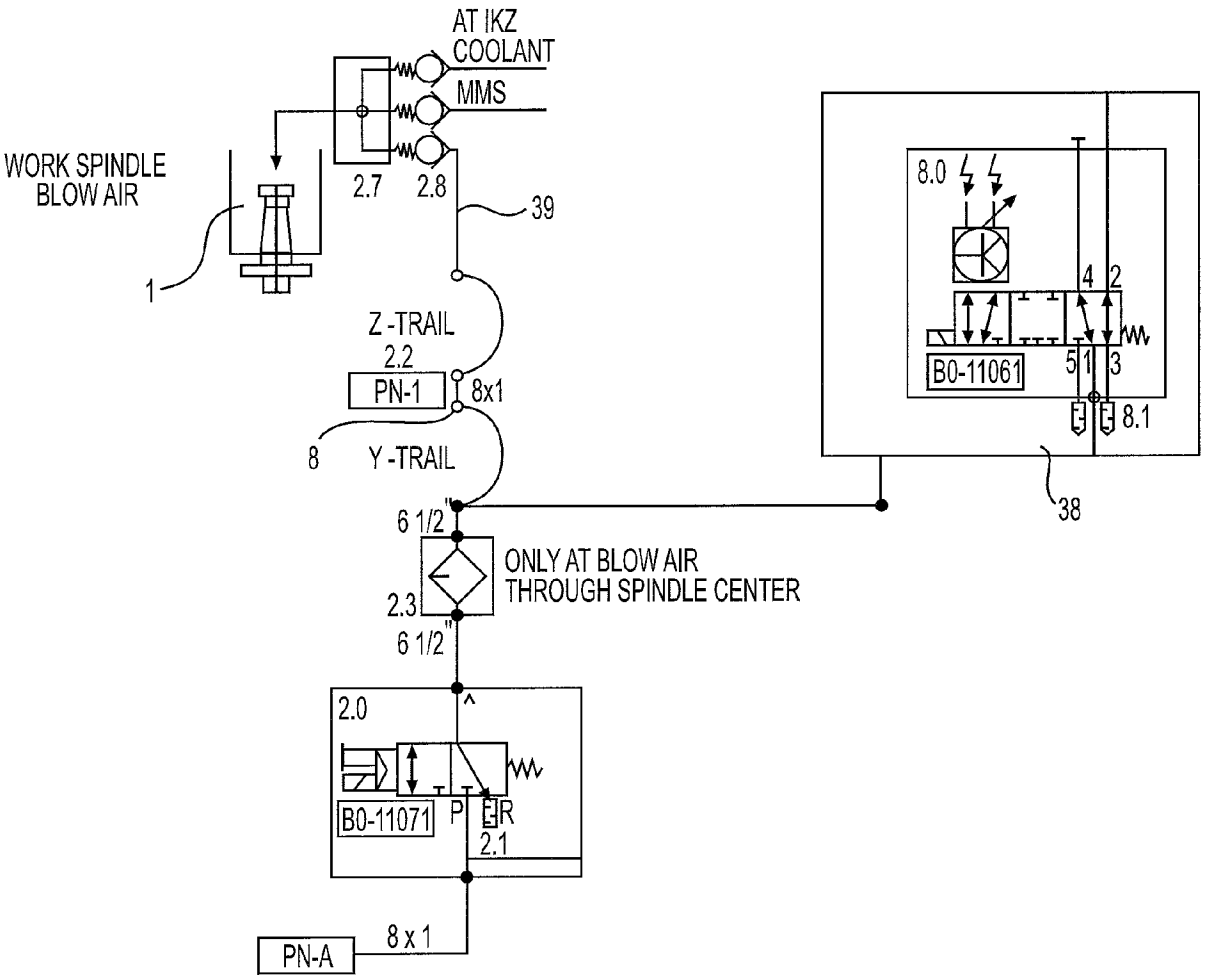
FIG. 5 is a diagram of the inner blow air control of the work spindle of the FIG. 1 apparatus with a pressure control valve.

The pressure which is used for forcing the polishing agent out of cylinder chamber 32 corresponds to the pressure in machine-side chamber 33 that is supplied via channel 18 from work spindle 1. During the polishing operation, the working fluids of the milling machine, for example, the coolant and lubricant, the outer compressed air, among others, are shut off and only the blow air supplied to the work spindle on the inside is effective. This blow air is controlled by a pressure control valve 38, which is shown in FIG. 5, and is connected to the compressed air supply line 39 to work spindle 1.

What is claimed is:

1. An apparatus for polishing workpiece surfaces, the apparatus being removably mountable in a tool holder of a program-controlled machine tool having a work spindle to which the tool holder is connected, the machine tool having a source of pressure at the tool holder, the apparatus comprising:

a polishing tool engageable with the tool holder, said polishing tool being elongated and having an axis and formed with a shank having a proximal end configured to removeably engage the tool holder and ending in a distal end to which distal end a polishing head is fixedly mounted, the polishing head being formed with defined passages through which polishing agent can flow out the polishing head;

a chamber in said tool shank having a proximal end connectable to the source of pressure when said polishing tool is mounted to the tool holder, said chamber having a bore through which polishing agent can flow from a distal end of said chamber toward said polishing head;

an exchangeable cartridge removably arranged in the chamber; and a displaceable piston in said chamber, said piston being located between the distal end of said chamber and the source of pressure connected to the proximal end of said polishing tool, the polishing agent, when present in said chamber, being between said piston and said bore in the distal end of said chamber, pressure from the machine tool being selectively applied to said piston to controllably move said piston axially toward said polishing head to force the polishing agent out of said chamber toward said polishing head.

2. The apparatus according to claim 1, wherein the polishing tool is configured to be transferred from a machine tool magazine to the work spindle of the program-controlled milling machine by means of a tool changer.

3. The apparatus according to claim 1, wherein the tool shank is made of one piece and is detachably connected to the tool holder for access to the chamber.

4. The apparatus according to claim 1, wherein the tool shank comprises:

an inner shank part configured to be connected in the tool holder; and an outer shank part containing the chamber, the polishing head being attached at the outer end of the outer shank part;

wherein the two shank parts are detachably connected to one another.

5. The apparatus according to claim 1, wherein the polishing head comprises at least partially of an elastomer and a fiber-composite material.

6. The apparatus according to claim 1, wherein the polishing head is comprised at least partially of an elastomer and a fiber-composite material.

7. The apparatus according to claim 5, wherein the polishing head comprises a core element made of fiber-reinforced elastomer which is coated with at least one layer of an insulating fiber material and of a high-strength synthetic fabric.

8. The apparatus according to claim 6, wherein the polishing head comprises a core element made of fiber-reinforced elastomer which is coated with at least one layer of an insulating fiber material and of a high-strength synthetic fabric.

9. The apparatus according to claim 1, wherein the source of pressure introduced into the chamber is a cooling lubricant of the machine tool.

10. The apparatus according to claim 1, and further comprising a control valve in the bore leading to the polishing head.

11. The apparatus according to claim 10, wherein the bore extending in the tool shank ends in a funnel-shaped pressure chamber from where several said defined passages extend through the polishing head to the outer side thereof.

12. The apparatus according to claim 1, wherein said displaceable piston is located in said cartridge.

13. The apparatus according to claim 1, wherein the polishing head comprises a core element made of fiber-reinforced elastomer coated with one or more layers of an insulating fiber material and high-strength synthetic fabric.

14. The apparatus according to claim 1, wherein the pressure agent fed into the chamber is the liquid cooling lubricant or compressed air of the machine tool.

15. An apparatus for polishing workpiece surfaces, the apparatus being removably mountable in a tool holder of a program-controlled machine tool having a work spindle to which the tool holder is connected, the machine tool having a source of pressure at the tool holder, the apparatus comprising:

a polishing tool engageable with the tool holder, said polishing tool being elongated and having an axis and formed with a shank having a proximal end configured to removeably engage the tool holder and ending in a distal end to which distal end a polishing head is fixedly mounted, the polishing head being formed with defined passages through which polishing agent can flow out the polishing head;

a chamber in said tool shank having a proximal end connectable to the source of pressure when said polishing tool is mounted to the tool holder, said chamber having a bore through which polishing agent can flow from a distal end of said chamber toward said polishing head; and a displaceable piston in said chamber, said piston being located between the distal end of said chamber and the source of pressure connected to the proximal end of said polishing tool, the polishing agent, when present in said chamber, being between said piston and said bore in the distal end of said chamber, pressure from the machine tool being selectively applied to said piston to controllably move said piston axially toward said polishing head to force the polishing agent out of said chamber toward said polishing head, the source of pressure introduced into the chamber is a cooling lubricant of the machine tool.

16. The apparatus according to claim 15, wherein the polishing head comprises a core element made of fiber-reinforced elastomer coated with one or more layers of an insulating fiber material and high-strength synthetic fabric.

17. An apparatus for polishing workpiece surfaces, the apparatus being removably mountable in a tool holder of a program-controlled machine tool having a work spindle to which the tool holder is connected, the machine tool having a source of pressure at the tool holder, the apparatus comprising:

a polishing tool engageable with the tool holder, said polishing tool being elongated and having an axis and formed with a shank having a proximal end configured to removeably engage the tool holder and ending in a distal end to which distal end a polishing head is fixedly mounted, the polishing head being formed with defined passages through which polishing agent can flow out the polishing head;

a chamber in said tool shank having a proximal end connectable to the source of pressure when said polishing tool is mounted to the tool holder, said chamber having a bore through which polishing agent can flow front a distal end of said chamber toward said polishing head;

a displaceable piston in said chamber, said piston being located between the distal end of said chamber and the source of pressure connected to the proximal end of said polishing tool, the polishing agent, when present in said chamber, being between said piston and said bore in the distal end of said chamber, pressure front the machine tool being selectively applied to said piston to controllably move said piston axially toward said polishing head to force the polishing agent out of said chamber toward said polishing head; and an exchangeable cartridge in said chamber, said displaceable piston being located in said cartridge.

18. The apparatus according to claim 17, wherein the polishing head comprises a core element made of fiber-reinforced elastomer coated with one or more layers of an insulating fiber material and high-strength synthetic fabric.

* * * * *